US006423679B1

(12) United States Patent
Capeci et al.

(10) Patent No.: US 6,423,679 B1
(45) Date of Patent: Jul. 23, 2002

(54) PROCESS FOR MAKING HIGH-ACTIVE DETERGENT AGGLOMERATES BY MULTI-STAGE SURFACTANT PASTE INJECTION

(75) Inventors: Scott William Capeci, North Bend; William Marion Hoffman; Paul R Mort, III, both of Cincinnati; Millard Edward Sullivan, North Bend, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/462,934

(22) PCT Filed: Jul. 8, 1998

(86) PCT No.: PCT/US98/14057

§ 371 (c)(1),
(2), (4) Date: Jan. 14, 2000

(87) PCT Pub. No.: WO99/03965

PCT Pub. Date: Jan. 28, 1999

Related U.S. Application Data

(60) Provisional application No. 60/052,551, filed on Jul. 15, 1997.

(51) Int. Cl.[7] ..... C11D 11/00

(52) U.S. Cl. ..... 510/444; 510/507; 510/509; 264/117

(58) Field of Search ..... 510/444, 507, 510/509; 264/117

(56) References Cited

U.S. PATENT DOCUMENTS

| | | | | | |
|---|---|---|---|---|---|
| 4,846,409 | A | | 7/1989 | Kaspar et al. | 241/21 |
| 5,366,652 | A | * | 11/1994 | Capeci et al. | 510/444 |
| 5,489,392 | A | * | 2/1996 | Capeci et al. | 510/444 |
| 5,516,447 | A | * | 5/1996 | Bauer et al. | 510/535 |
| 5,516,448 | A | * | 5/1996 | Capeci et al. | 510/444 |
| 5,576,285 | A | | 11/1996 | France et al. | 510/444 |
| 5,691,297 | A | * | 11/1997 | Nassano et al. | 510/444 |
| 5,919,747 | A | * | 7/1999 | Kazuta et al. | 510/444 |
| 5,929,021 | A | * | 7/1999 | Dhanuka et al. | 510/444 |
| 5,958,865 | A | * | 9/1999 | Kline et al. | 510/444 |

FOREIGN PATENT DOCUMENTS

| | | | | | |
|---|---|---|---|---|---|
| DE | 44 35 743 | A1 | | 8/1995 | C11D/3/08 |
| EP | 0618289 | A1 | * | 10/1994 | |
| JP | 8003599 | A | * | 1/1996 | |
| JP | 8027494 | A | * | 1/1996 | |
| WO | WO 96/04359 | A1 | | 2/1996 | C11D/11/04 |
| WO | WO 97/12956 | | | 4/1997 | C11D/11/00 |
| WO | WO 97/22685 | | | 6/1997 | C11D/17/06 |
| WO | WO 97/30145 | | | 8/1997 | C11D/11/00 |
| WO | WO 98/14549 | | | 4/1998 | C11D/11/00 |
| WO | WO 98/14552 | | | 4/1998 | C11D/11/00 |
| WO | WO 98/14553 | | | 4/1998 | C11D/11/00 |
| WO | WO 98/14554 | | | 4/1998 | C11D/11/00 |
| WO | WO 98/14555 | | | 4/1998 | C11D/11/00 |
| WO | WO 98/14557 | | | 4/1998 | C11D/11/00 |
| WO | WO 98/14558 | | | 4/1998 | C11D/11/00 |
| WO | WO 98/14559 | | | 4/1998 | C11D/11/00 |
| WO | WO 98/58046 | | | 12/1998 | C11D/11/00 |
| WO | WO 98/58047 | | | 12/1998 | C11D/11/00 |
| WO | WO 98/58048 | | | 12/1998 | C11D/11/00 |
| WO | WO 99/00475 | | | 1/1999 | C11D/11/04 |

* cited by examiner

*Primary Examiner*—Lorna M. Douyon
(74) *Attorney, Agent, or Firm*—Brian M. Bolam; Kim William Zerby; Steven W. Miller

(57) ABSTRACT

A process is provided for producing high-active detergent agglomerates through multi-stage surfactant paste injection. According to the process, starting detergent materials are mixed with an initial amount of surfactant paste and then allowed to age for a specified period of time. Following the initial paste injection and aging period, additional amounts of surfactant paste are injected incrementally to make a final detergent agglomerate having at least about 45% by weight of surfactant.

16 Claims, No Drawings

PROCESS FOR MAKING HIGH-ACTIVE DETERGENT AGGLOMERATES BY MULTI-STAGE SURFACTANT PASTE INJECTION

This is a 371 application of PCT International Application Ser. No. PCT/US98/14057, filed Jul. 8, 1998; which claims priority to U.S. Provisional Application Ser. No. 60/052,551, filed Jul. 15, 1997.

FIELD OF THE INVENTION

The present invention generally relates to a process for increasing surfactant paste content in high density detergents. More particularly, the process involves first injecting surfactant paste into starting detergent materials and agglomerating the mixture, then allowing the agglomerated mixture to age for a specified period of time. After the aging period, incremental amounts of additional surfactant paste are injected into the mixture until the paste capacity of the detergent agglomerates is maximized. Detergent agglomerates produced by the process have surfactant levels in excess of 45% by weight.

BACKGROUND OF THE INVENTION

There has been considerable interest of late in the detergent industry in "compact" detergents. In various countries around the world, compact detergents are increasingly popular with consumers because they are less bulky than conventional detergents, and thus easier to transport from the store to the home. Compact detergents are also easier for consumers to use because less detergent is needed for a typical dosage in a laundry machine. Compact detergents are advantageous not only to consumers, but also to detergent manufacturers because they provide cost savings achieved through decreased packaging requirements. In addition, the smaller detergent packages are seen as more "environmentally friendly". These benefits to consumers and manufactures have stimulated strong interest within the detergent industry to find improved methods of manufacturing compact detergents.

Generally, there are two primary processes by which detergent granules or powders are manufactured. The first type of process involves spray-drying an aqueous detergent slurry in a spray-drying tower. Usually, the detergent slurry enters the tower from the top and mixes with a counterflow stream of hot air that evaporates the excess water. This process produces light, highly porous, low-density detergent granules. In the second type of process, various powdered detergent ingredients are dry mixed with a binder, such as a nonionic surfactant, and agglomerated into larger detergent granules. The mixing and agglomeration are normally accomplished by passing the detergent powders and binder through a high-speed mixer/densifier and a moderate-speed mixer/densifier in series. The agglomeration process is recognized as one of the more feasible methods of manufacturing highly dense detergents, and much of the efforts to improve the manufacture of compact detergents have centered around it.

One of the factors that limits the density of detergent granules produced by an agglomeration process is the amount of surfactant the granules can hold. Under typical agglomeration operations, there is a critical surfactant saturation point which cannot be exceeded. If this saturation point is exceeded and too much surfactant paste is mixed with the starting detergent powders, the detergent mixture will cake and gum up. Caking of the powder/binder mixture can produce detergent clumps that tend to smear onto the blades and wall of the mixer/densifier, resulting in increased friction and power draw. In addition, excess caking of the detergent mixture can lead to an uncontrolled soap buildup between the mixer blades and the wall of the mixing vessel that can cause damaging vibrations during operation of the machinery. Yet another problem with exceeding the surfactant levels saturation point is that the flowability of the agglomerated detergent granules can be impaired due to stickiness from the typically oily surfactant.

Accordingly, there is a need within the detergent industry for a process of increasing the surfactant content in agglomerated detergent granules so that high density detergents having higher levels of surfactant can be more efficiently manufactured. It is desired that this process yield an agglomerated detergent having excellent flow and handleability. It is further desired that this process not result in caking or clumping of the mixture, and that it be economical to operate in terms of power requirements of mixing and agglomerating the surfactant paste and powders. It is also desired that this process yield high-density detergent agglomerates without causing excess vibration from uncontrolled soap buildup that could destroy costly industrial machinery.

BACKGROUND ART

The following references relate to detergent manufacturing processes: U.S. Pat. No. 5,489,392 (Capeci et al., 1996); U.S. Pat. No. 5,486,303 (Capeci et al., 1996); U.S. Pat. No. 5,366,652 (Capeci et al., 1994); German Patent No. 4216774A1 (Hans-Friedrich Kruse et al., 1993); U.S. Pat. No. 5,160,657 (Bortolotti et al., 1992); U.S. Pat. No. 5,133,924 (Appel et al., 1992); EP 0510746A2 (Goovaerts et al., 1992); and EP 0351937 (Hollingsworth et al., 1989); U.S. Pat. No. 5,149,455 (Jacobs et al., 1992); U.S. Pat. No. 5,009,804 (Clayton et al., 1991); U.S. Pat. No. 4,715,979 (Moore et al., 1987); U.S. Pat. No. 4,637,891 (Dewel et al., 1987); and U.S. Pat. No. 4,006,110 (Kenny et al., 1977).

SUMMARY OF THE INVENTION

The present invention meets the aforementioned needs in the art by providing a process for increasing the total amount of surfactant in an agglomerated compact detergent product. The process involves making multiple injections of surfactant paste into one or more serially positioned mixers/densifiers. An important aspect of the process is that the initially agglomerated detergent powders and paste are aged for a period of time determined by the kinetics of the specific reaction phase transformation. This aging step is performed by either additional mixing after the paste and powders are first combined, or in a separate processing step. After aging, the initial agglomerates are treated with additional incremental surfactant injections until the desired weight fraction of surfactant in the agglomerates is reached. This process resolves a long-felt need in the detergent industry for a method of increasing surfactant levels in compact agglomerates that is workable in large-scale commercial operations. All percentage, ratios, and proportions used herein are by weight unless otherwise indicated; all documents, including patents and publications, cited herein are incorporated by reference.

In accordance with one aspect of the invention, a process for making high-surfactant content detergent agglomerates is provided. Specifically, the process comprises the steps of: (a) agglomerating starting detergent material and a first portion of surfactant paste into a first mixer/densifier so as to form initial agglomerates; (b) aging said initial agglomerates for a predetermined amount of time; (c) mixing said initial agglomerates and a second portion of said surfactant paste into a second mixer/densifier so as to form higher surfactant-containing agglomerates; and (d) repeating said step (c) so as to form said high-surfactant content detergent agglomerates having at least about 45% by weight of surfactant. The surfactant paste used in the process is selected from the group consisting of anionic, cationic, nonionic, zwitterionic, and ampholytic surfactants, and compatible mixtures thereof In another embodiment of the invention, the starting detergent material comprises from about 1% to about 80% by weight of a detergent aluminosilicate builder and from about 9% to about 60% by weight of sodium carbonate. Mean residence times of the initial agglomerates in the first mixer/densifier range from about 1 second to about 120 seconds, while the mean residence time of the higher surfactant-containing agglomerates in the second mixer/densifier can range from about 1 second to about 30 seconds. Also, the process includes aging the initial agglomerates for at least about 10 seconds before mixing with a second portion of surfactant paste.

In another embodiment of the invention, the initial agglomerates and higher surfactant-containing agglomerates have mean particle diameters of less than about 400 $\mu$m. Further, the high-surfactant content detergent agglomerates have a density of from about 600 g/l to about 850 g/l. In another embodiment of the process, the temperature of the initially injected surfactant paste is from about 55° C. to about 70° C., and the temperature of the starting detergent material is from about 10° to about 30° C. In addition, the high-surfactant content detergent agglomerates may also comprise at least about 50% by weight of surfactant.

In a preferred embodiment of the process, the high-surfactant content detergent agglomerates are made by: (a) agglomerating starting detergent material and a first portion of surfactant paste into a first mixer/densifier so as to form initial agglomerates, wherein said starting detergent material comprises from about 28% to about 35% by weight of a detergent aluminosilicate builder and from about 12% to about 18% by weight of sodium carbonate, and said initial agglomerates have a mean residence time of from about 5 seconds to about 10 seconds in said first mixer/densifier; (b) aging said initial agglomerates for at least about 180 seconds; (c) mixing said initial agglomerates and said second portion of surfactant paste so as to form higher surfactant-containing agglomerates, wherein said higher surfactant-containing agglomerates have a mean residence time of from about 2 seconds to about 5 seconds in said mixer/densifier; and (d) repeating said step (c) so as to form said high-surfactant content detergent agglomerates having at least 45% by weight of surfactant.

A further embodiment of the process encompasses the additional step of evaporating moisture from the initial agglomerates before feeding the agglomerates into the second mixer/densifier. Another embodiment of the process includes the extra step of drying the high-surfactant content detergent agglomerates. Detergent compositions made by the process described herein are also claimed.

Accordingly, it is an object of the invention to provide a process for producing high-density detergent agglomerate that have high levels of surfactant. Also, it is an object of the invention to provide a process that facilitates efficient large-scale production of compact detergents. These and other objects, features and attendant advantages of the present invention will become apparent to those skilled in the detergent art from reading the following detailed description of the preferred embodiment and the appended claims.

DETAILED DESCRIPTION OF THE PREFERRED EMBODIMENT

The present invention can be used in the large-scale production of compact detergent agglomerates containing high levels of surfactant. As described below, the invention incorporates key process steps with defined material parameters to achieve the increased surfactant levels.

Mixing/Agglomeration Process

Generally speaking, the process entails multiple steps of agglomeration and mixing. First, starting detergent material in powdered form and surfactant paste are agglomerated to form initial detergent agglomerates. After an aging period, additional amounts of surfactant are incrementally added and mixed with the initial detergent agglomerates to form higher surfactant-containing agglomerates. The mean residence time of agglomeration for the starting detergent materials and initial charge of surfactant paste is from about 1 second to about 120 seconds, preferably from about 4 seconds to about 30 seconds, and most preferably from about 5 seconds to about 10 seconds. The speed of the mixer can vary depending on the type of mixer used and the desired properties of the final product. An important aspect of the initial agglomeration step is that the starting detergent powders are filly dispersed in the surfactant paste so that initial detergent agglomerates are formed. The mean particle diameter of the initial detergent agglomerates should be less than about 400 $\mu$m, preferably less than about 300 $\mu$m, and most preferably less than about 200 $\mu$m.

After initially agglomerating the starting detergent powders and surfactant paste, the resulting initial detergent agglomerates are aged for a predetermined amount of time. The aging step is critical to the invention and facilitates material transformations necessary for increasing the surfactant content of the agglomerates to levels above about 45% and even above about 50%. Although not wishing to be bound by theory, it is believed that the aging period increases the surfactant loading capacity through evaporation of free moisture from the surfactant paste and through hydration of the starting detergent powders. It is therefore important during the aging process that there be adequate airflow and that the contacting air has high moisture capacity to absorb evaporated moisture from the agglomerates. The amount of time that the initial detergent agglomerates should be allowed to age differs depending on the specific composition of the surfactant paste and starting detergent materials. In continuous operations, the minimum aging time should be at least about 10 seconds, preferably at least about 60 seconds, and most preferably at least about 180 seconds. It is noted that these minimum aging times are easily met in single-mixer batch operations, where emptying and cleaning the mixer in-between surfactant paste injections may take 30 to 45 minutes.

Following the aging period, the initial agglomerates are treated to additional paste injection and mixing to increase incrementally the surfactant content of the agglomerates. The mean residence time of mixing for each subsequent mixing stage is generally from about 1 second to about 30 seconds, preferably from about 2 seconds to about 10 seconds, and most preferably from about 2 seconds to about 5 seconds. The subsequent mixing step or steps can be utilized not only to increase the total surfactant content in the final detergent product but also to refine the particle size and density of the detergent product. The mean particle diameter of the final high-surfactant content detergent agglomerates will generally range from about 300 $\mu$m to about 1000 $\mu$m, preferably from about 400 μm to about 800 μm, and most preferably from about 500 μm to about 700 μm. The density of the high-surfactant content detergent agglomerates can range from about 600 g/l to about 850 g/l, preferably from about 700 g/l to about 850 g/l, and most preferably from about 750 g/l to about 850 g/l.

The process is amenable to a wide range of temperatures for the surfactant paste and starting detergent material. The temperature of the surfactant paste in either the initial injection or subsequent injections can vary from about 55° C. to about 70° C., although for optimum surfactant loading the temperature will preferably be from about 55° C. to about 60° C., and most preferably about 55° C. The temperature of the starting detergent material can also vary from about 10° C. to about 30° C., although the temperature is preferably from about 10° C. to about 25° C., and most preferably from about 10° C. to about 20° C. After the high-surfactant content detergent agglomerates are formed, the agglomerates can be treated to a drying step, if desired, to remove excess moisture and render the product non-sticky and handleable.

The high surfactant-loading process of the invention can be employed in either batch or continuous operation. If a batch operation is performed, usually only one mixer/densifier is used. Continuous operations can employ a series of mixer/densifiers with the particular parameters and configuration of equipment depending on the desire properties of the final product. Typical mixer/densifiers used in the process include but are not limited to a Lödige Recycler CB-30, a Lödige Recycler KM-600 "Ploughshare," conventional twin-screw mixers, mixers commercially sold as Eirmich, Schugi, O'Brien, and Drais mixers, and combinations of these and other mixer/densifiers.

Surfactant Paste

The surfactant paste used in the process is preferably in the form of an aqueous viscous paste, although other forms are also contemplated by the invention. This viscous surfactant paste has a viscosity of from about 5,000 cps to about 100,00 cps, more preferably from about 10,000 cps to about 80,000 cps, and contains at least about 10% water, more preferably at least about 20% water. The viscosity is measured at 70° C. and at shear rates of about 10 to 100 $sec^{-1}$. Furthermore, the surfactant paste preferably comprises from about 70% to about 95%, more preferably from about 75% to about 85% of a detersive surfactant, and the balance water and other conventional detergent ingredients.

The detersive surfactant in the surfactant paste is preferably selected from anionic, nonionic, zwitterionic, ampholytic and cationic classes and compatible mixtures thereof Detergent surfactants useful herein are described in U.S. Pat. No. 3,664,961, Norris, issued May 23, 1972, and in U.S. Pat. No. 3,919,678, Laughlin et al., issued Dec. 30, 1975. Useful cationic surfactant also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference. Of the surfactants, anionics and nonionics are preferred and anionics are most preferred.

Nonlimiting examples of the preferred anionic surfactants useful in the surfactant paste include the conventional $C_{11}$–$C_{18}$ alkyl benzene sulfonates ("LAS"), primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)\ CH_3$ and $CH_3\ (CH_2)_y(CHOSO_3^-M^+)\ CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfates ("$AE_xS$"; especially EO 1–7 ethoxy sulfates).

Optionally, other exemplary surfactants include $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amino oxides, and the like, can also be included. The $C_{10}$–$C_{18}$ N-alkyl polyhydroxy fatty acid amides can also be used. Typical examples include the $C_{12}$–$C_{18}$ N-methylglucamides. See WO 92/06154. Other sugar-derived surfactants include the N-alkoxy polyhydroxy fatty acid amides, such as $C_{10}$–$C_{18}$ N-(3-methoxypropyl) glucamide. The N-proply through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Starting Detergent Material

The starting detergent material in the present process comprises detergency builders which can be generally selected from the various water-soluble, alkali metal, ammonium or substituted ammonium phophates, polyphosphates, phosphonates, polyphosphonates, carbonates, borates, polyhydroxy sulfonates, polyacetates, carboxylates, and polycarboxylates. Preferred are the alkali metal, especially sodium, salts of the above. Preferred for use herein are the phosphates, carbonates, $C_{10}$–$C_{18}$ fatty acids, polycarboxylates, and mixtures thereof More preferred are sodium tripolyphosphate, tetrasodium pyrophosphate, citrate, tartrate mono- and di-succinates, and mixtures thereof.

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substatially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}\cdot yH_2O$$

wherein M is sodium or hydrogen, x is from about 1.9 to about 4 and y is from about 0 to about 20. More preferably, the crystalline layered sodium silicate has the formula $$NaMSi_2O_5\cdot yH_2O$$

wherein M is sodium or hydrogen, and y is from about 0 to about 20. These and other crystalline layered sodium silicates are discussed in Corkill et al., U.S. Pat. No. 4,605,509, previously incorporated herein by reference.

Specific examples of inorganic phophate builders are sodium and potassium trypolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Other suitable polycarboxylates for use herein are the polyacetl carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

It is preferred that the starting detergent material in the present process comprise anhydrous powders. As used herein, the term "anhydrous" means that the material, while starting out in a crystalline phase containing no water, is hydratable, or capable of absorbing water rapidly to form a crystalline phase with some number of water groups included in the crystalline stoichiometry. Preferably, the anhydrous powders are selected from the group consisting of carbonates, sulfates, carbonate/sulfate complexes, and mixtures thereof. While not intending to be limiting, other suitable anhydrous powders include powdered tripolyphosphate, powdered tetrasodium pyrophosphate, citrate, powdered carbonates such as calcium carbonate, powdered sulfates and mixture thereof Also, the anhydrous powders can be selected from group consisting of absorbent gelling materials, cellulose-based materials and combinations thereof Suitable absorbent gelling materials are disclosed in Brandt et al., U.S. Patent Reissue No. 32,649 (commonly assigned), the disclosure of which is incorporated herein by reference. Suitable cellulose-based materials are disclosed in Herron, U.S. Pat. No. 5,183,707 and Herron et al., U.S. Pat. No. 5,137,537, the disclosure of which are incorporated by reference. It is preferred that the anhydrous powders be present in an amount from about 9% to about 60%, preferably from about 9% to about 21%, and most preferably from about 12% to about 18% by weight of the high-surfactant content detergent agglomerates measured on a wet basis. Sodium carbonate is the preferred anhydrous powder.

The starting detergent material of the present process may also comprise from about 1% to about 80% a detergency builder selected from the group consisting of aluminosilicates, crystalline layered silicates and mixtures thereof Preferably, the aluminosilicate detergency builder is present in an amount from about 21% to about 49%, and most preferably from about 28% to about 35% by weight of the high-surfactant content detergent agglomerates measured on a wet basis. The aluminosilicates or aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al., U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. Aluminosilicates disclosed in Corkill et al., U.S. Pat. No. 4,605,509 (Procter & Gamble), the disclosure of which is incorporated herein by reference, typically which have been overdried are suitable for use herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning election microscope (SEM). The preferred particle size diameter of the aluminosilicate is from about 0.1 micron to about 10 microns, more preferably from about 0.5 microns to about 9 microns. Most preferably, the particle size diameters is from about 1 microns to about 8 microns.

Preferably, the aluminosilicate ion exchange material has the formula $$Na_z[(AlO_2)_z \cdot (SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12} \cdot (SiO_2)_y]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al., U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

Adjunct Detergent Ingredients

The starting detergent material in the present process can include adjunct detergent ingredients and/or, any number of additional ingredients can be incorporated in the detergent composition during subsequent steps of the present process. These adjunct ingredients include bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al., issued August 9, 1988, Column 6, line 3 through Column 7, line 24, incorporated herein by reference. Suitable additional detergency builders for use herein are enumerated in the aforementioned Baskerville patent, Column 13, line 54 through Column 16, line 16, and in U.S. Pat. No. 4,663,071, Bush et al., issued May 5, 1987, both incorporated herein by reference.

The following example is intended to be illustrative only and not intended to be limiting in scope.

EXAMPLE

This Example illustrates the process of the invention which produces high-surfactant detergent agglomerates having at least about 45% of surfactant. The process detailed below is a three-stage surfactant paste injection sequence conducted in a single Lödige CB-30 mixer. First, starting detergent material comprising sodium carbonate and sodium aluminosilicate is added to the mixer and surfactant paste is injected into the mixer so that the amounts of sodium carbonate, sodium aluminosilicate and surfactant paste are 20.0%, 46.0%, and 35.0%, respectively. The starting detergent materials and surfactant paste are agglomerated for approximately 5 to 10 seconds to produce initial agglomerates having a mean particle diameter of about 150 $\mu$m. The initial agglomerates are collected and allowed to age in open bags for approximately 30 minutes while the mixer is cleaned and prepared for the second injection of surfactant paste. The initial agglomerates are then fed from the open bags into the original mixer and injected with additional surfactant paste so that the proportions of initial agglomerates and additional surfactant paste are 74.0% and 26.0%, respectively. This mixture is agglomerated for approximately 2 to 5 seconds, and the resulting second agglomerates are collected and allowed to age in open bags for about 30 minutes while the mixer is cleaned for the next injection of surfactant paste. The second agglomerates are then poured into the cleaned mixer from the open bags, and a third injection of paste is added so the proportion of newly added paste is 13.0% of the mixer's contents. The mixture is agglomerated to make high-surfactant containing third agglomerates which are then dried to a residual moisture of 6% in an Aeromatic fluid bed dryer manufactured by the Niro Corporation. The finished high-surfactant content detergent agglomerates have a total surfactant weight percent of 45.4%. The above sequence is described in Table I below:

TABLE I

| | Raw Material (wt %) | Mean Particle Diameter ($\mu$m) | Total Surfactant (wt %) |
|---|---|---|---|
| First Paste Injection: | | | |
| Sodium carbonate | 20.0 | 75 | 0.0 |
| Sodium aluminosilicate | 46.0 | 5 | 0.0 |
| Surfactant paste† | 35.0 | — | 75.0 |
| Initial agglomerates | 100.0 | 150 | 26.0 |
| Second Paste Injection: | | | |
| Initial agglomerates | 74.0 | 150 | 26.0 |
| Surfactant paste† | 26.0 | — | 75.0 |
| Second agglomerates | 100.0 | 250 | 39.0 |
| Third Paste Injection: | | | |
| Second agglomerates | 87.0 | 275 | 39.0 |
| Surfactant paste† | 13.0 | — | 75.0 |
| Third agglomerates | 100.0 | 475 | 44.0 |

†Comprises 95% $C_{14-15}$ alkyl sulfate/alkyl ethoxy sulfate and 5% water.

The final composition of the high-surfactant content detergent agglomerate product is set forth in Table II below:

TABLE II

| Component | % Weight |
|---|---|
| $C_{14-15}$ alkyl sulfate/alkyl ethoxy sulfate | 45.4 |
| Sodium aluminsilicate | 30.5 |
| Sodium carbonate monohydrate | 15.2 |
| Misc. (water, perfume, etc.) | 8.9 |
| Total | 100.0 |

The density of the final high-surfactant content detergent agglomerates is 750 g/l and the mean particle diameter is 475 microns ($\mu$m).

Having thus described the process in detail, it will be obvious to those skilled in the art that various changes may be made without departing from the scope of the invention and the process is not to be considered limited to what is described in the specification.

What is claimed is:

1. A process for making high-surfactant content detergent agglomerates comprising the steps of:

(a) agglomerating starting detergent material and a first portion of surfactant paste into a first mixer/densifier at a mean residence time of from about 1 second to about 30 seconds so as to form initial agglomerates;

(b) aging said initial agglomerates for at least about 180 seconds;

(c) mixing said initial agglomerates and a second portion of said surfactant paste into a second mixer/densifier so as to form higher surfactant-containing agglomerates; and (d) repeating said step (c) so as to form said high-surfactant content detergent agglomerates having at least about 45% by weight of surfactant.

2. A process according to claim 1 wherein said starting detergent material comprises from about 1% to about 80% by weight of a detergent aluminosilicate builder and from about 9% to about 60% by weight of sodium carbonate.

3. A process according to claim 2 wherein said surfactant paste is selected from the group consisting of anionic, cationic, nonionic, zwitterionic, and ampholytic surfactants, and compatible mixtures thereof.

4. A process according to claim 1 wherein the mean residence time of said higher surfactant-containing agglomerates in said second mixer/densifier is from about 1 second to about 30 seconds.

5. A process according to claim 1 wherein said initial agglomerates of said step (a) have mean particle diameters of less than about 400 $\mu$m.

6. A process according to claim 1 wherein the density of said high-surfactant content detergent agglomerates is from about 600 g/l to about 850 g/l.

7. A process according to claim 1 wherein the temperature of said surfactant paste in said step (a) is from about 55° C. to about 70° C. and the temperature of said starting detergent material in said step (a) is from about 10° C. to about 30° C.

8. A process according to claim 1 wherein said high-surfactant content detergent agglomerates have at least about 50% by weight of surfactant.

9. A process according to claim 1 further comprising the step of evaporating moisture from said initial agglomerates before feeding said initial agglomerates into said second mixer/densifier.

10. A process according to claim 1 further comprising the step of drying said high-surfactant content detergent agglomerates.

11. A process for making high-surfactant content detergent agglomerates comprising the steps of:

(a) agglomerating starting detergent material and a first portion of surfactant paste into a first mixer/densifier so as to form initial agglomerates, wherein said detergent material comprises from about 28% to about 35% by weight of a detergent aluminosilicate builder and from about 12% to about 18% by weight of sodium carbonate, and said initial agglomerates have a mean residence time of from about 5 seconds to about 10 seconds in said first mixer/densifier;

(b) aging said initial agglomerates for at least about 180 seconds;

(c) mixing said initial agglomerates and a second portion of surfactant paste so as to form higher surfactant-containing agglomerates, wherein said higher surfactant-containing agglomerates have a mean residence time of from about 2 seconds to about 5 seconds in a second mixer/densifier; and (d) repeating said steps (c) so as to form said high-surfactant content detergent agglomerates having at least about 45% by weight of surfactant.

12. A process according to claim 11 wherein said surfactant paste is selected from the group consisting of anionic, cationic, nonionic, zwitterionic, and ampholytic surfactants, and compatible mixtures thereof.

13. A process according to claim 11 wherein said initial agglomerates of said step (a) have mean particle diameters of less than about 400 $\mu$m.

14. A process according to claim 11 wherein the density of said high-surfactant content detergent agglomerates is from about 750 g/l to about 850 g/l.

15. A process according to claim 11 wherein the temperature of said surfactant paste in said step (a) is about 55° C. and the temperature of said starting detergent material in said step (a) is from about 10° C. to about 20° C.

16. A process according to claim 11 wherein said high-surfactant content detergent agglomerates have at least about 50% by weight of surfactant.

* * * * *